United States Patent [19]

Nakamura et al.

[11] Patent Number: 4,569,652

[45] Date of Patent: Feb. 11, 1986

[54] COMBUSTION CYLINDER CONSTRUCTION FOR OIL SPACE HEATER

[75] Inventors: Kazuharu Nakamura, Nagoya; Yoshio Mito, Gifu; Yutaka Nakanishi, Kounan, all of Japan

[73] Assignee: Toyotomi Kogyo Co., Ltd., Aichi, Japan

[21] Appl. No.: 449,325

[22] Filed: Dec. 13, 1982

[30] Foreign Application Priority Data

| | | | |
|---|---|---|---|
| Dec. 23, 1981 | [JP] | Japan | 56-214072 |
| Dec. 23, 1981 | [JP] | Japan | 56-214073 |
| Dec. 23, 1981 | [JP] | Japan | 56-214074 |

[51] Int. Cl.[4] ..... F23D 3/12; F23D 3/14

[52] U.S. Cl. ..... 431/201; 431/195; 431/309; 126/96; 126/97

[58] Field of Search ..... 431/195, 201, 309, 311; 126/96, 97, 92 A

[56] References Cited

U.S. PATENT DOCUMENTS

| | | | |
|---|---|---|---|
| Re. 11,575 | 11/1896 | Blackford | 431/201 |
| 1,214,547 | 2/1917 | Jeavons et al. | 431/309 |
| 1,341,494 | 5/1920 | Closs | 431/309 |
| 3,234,951 | 2/1966 | Schilling | 220/306 X |
| 3,701,450 | 10/1972 | Belzberg | 220/24 |
| 4,484,886 | 11/1984 | Nakamura et al. | 431/201 |

FOREIGN PATENT DOCUMENTS

| | | | |
|---|---|---|---|
| 145696 | 5/1951 | Australia | 431/201 |
| 35707 | 10/1972 | Japan . | |
| 46678 | 11/1976 | Japan . | |
| 24347 | 8/1979 | Japan . | |
| 55-168020 | 12/1981 | Japan | 431/195 |
| 55-168021 | 12/1981 | Japan | 431/195 |
| 58-13908 | 1/1983 | Japan . | |
| 58-13909 | 1/1983 | Japan . | |
| 58-108308 | 6/1983 | Japan . | |
| 58-108309 | 6/1983 | Japan . | |

*Primary Examiner*—Margaret A. Focarino
*Assistant Examiner*—Allen J. Flanigan

[57] ABSTRACT

A combustion cylinder construction for an oil space heater is disclosed which is constructed to dispose a uniform air flow forming mechanism between an outermost heat-permeable cylinder and an outer cylindrical member of a double combustion cylinder, thereby not only to keep the double combustion cylinder in a red-heated state, but also to carry out the formation of a uniform and stable white-yellow flame and to complete combustion at a flame spreading means. There is also disclosed a combustion cylinder construction which further includes a heat ray reflecting means to render the temperature profiles through the heat-permeable cylinder as uniform as possible, resulting in an oil space heater having a long service life.

18 Claims, 5 Drawing Figures

COMBUSTION CYLINDER CONSTRUCTION FOR OIL SPACE HEATER

BACKGROUND OF THE INVENTION

1. Field of the Invention

This invention relates to an improved combustion cylinder construction for an oil space heater, and more particularly to a combustion cylinder construction of the type for radiating heating rays from a double combustion cylinder red-heated by a primary combustion and a white-yellow flame formed at a flame spreading means by a secondary combustion which is capable of improving the radiation efficiency of heat rays and accomplishing the discharge of a clean combustion gas and improvement in combustion performance.

2. Description of the Prior Art

There has been conventionally known a combustion cylinder construction for an oil space heater of the type for emitting heat rays from a double combustion cylinder red-heated by a primary combustion and a white-yellow flame formed by a secondary combustion carried out at a flame spreading means and cleaning a combustion gas due to the secondary combustion. The conventional combustion cylinder construction has disadvantages that it is substantially impossible to uniformly and efficiently red-heat the double combustion cylinder and that an oil burner having the construction incorporated therein is complicated in structure, because the double combustion cylinder and the flame spreading means disposed above the cylinder are respectively surrounded by separate heat-permeable cylinders provided independent from each other in the vertical direction.

In view of such disadvantages, a combustion cylinder construction has been proposed which is constructed in such a manner that a double combustion cylinder and a flame spreading means are surrounded by a single common heat-permeable cylinder. However, such combustion cylinder construction is not adapted to render the supply of a combustion air through a space between an outer cylindrical member of the double combustion cylinder and the heat-permeable cylinder to the flame spreading means uniform with respect to the entire periphery of the flame spreading means, because it is substantially impossible to provide a gap of a uniform distance between the heat-permeable cylinder and a top plate of the outer cylindrical member of the double combustion cylinder. This does not allow a uniform and stable long white-yellow flame to be formed at the flame spreading means as well as the double combustion cylinder to be uniformly and efficiently red-heated.

Furthermore, in such conventional combustion cylinder construction, heat rays are discharged from the combustion cylinder construction through two areas of the single heat-permeable cylinder corresponding to the double combustion cylinder and flame spreading means of the combustion cylinder construction to the exterior of an oil space heater, therefore, heat rays discharged through a section of the heat-permeable cylinder interposed between these two areas are very little in quantity. This causes the heat-permeable cylinder to have nonuniform temperature profiles therethrough, so that an oil space heater having such combustion cylinder construction incorporated therein has a substantially decreased service life.

BRIEF SUMMARY OF THE INVENTION

The present invention has been made in view of the foregoing disadvantages of the prior art.

Accordingly, it is an object of the present invention to provide a combustion cylinder construction for an oil space heater capable not only of keeping an outer cylindrical member of a double combustion cylinder uniformly and efficiently red-heated, but also of carrying out the formation of a uniform and stable long white-yellow flame at a flame spreading means and the complete combustion of a combustible gas and an incomplete combustion gas at the flame spreading means, to thereby significantly improve the radiation efficiency and combustion performance and accomplish the discharge of a clean combustion gas.

It is another object of the present invention to provide a combustion cylinder construction for an oil space heater capable of more uniformly and efficiently red-heating an outer cylindrical member of a double combustion cylinder as well as accomplishing the above-mentioned object.

It is a further object of the present invention to provide a combustion cylinder construction for an oil space heater also capable of rendering the temperature profiles through a heat-permeable cylinder as uniform as possible to allow the oil space heater to have a long service life.

In accordance with the present invention, there is provided a combustion cylinder construction for an oil space heater comprising a double combustion cylinder including an inner cylindrical member and an outer cylindrical member each formed of a heat-resistant material and with through-holes, the double combustion cylinder being adapted to mix fuel oil vaporized from a wick with air introduced from a part of the through-holes to form a combustible gas and burn a part of the combustible gas in a first space defined between the inner cylindrical member and the outer cylindrical member; a flame spreading means disposed above the double combustion cylinder to burn the rest of the combustible gas and also any incompletely combusted gas contained in gases generated from the double combustion cylinder, to form a white-yellow flame; a single heat-permeable cylinder formed of a heat-resistant material and disposed to surround the double combustion cylinder and flame spreading means; and a uniform flow forming mechanism for rendering the flow of combustion air supplied through a second space between the double combustion cylinder and the heat-permeable cylinder to the outside of the flame spreading means substantially uniform with respect to the entire periphery of the flame spreading means. The uniform flow forming mechanism comprises a top plate provided at the upper end of the outer cylindrical member so as to extend toward the heat-permeable cylinder and a spacer means disposed between the top plate and the heat-permeable cylinder to space the top plate from the heat-permeable cylinder at a fixed distance, and at least one of the top plate and spacer means is formed with a passage for uniformly supplying a combustion air to the flame spreading means.

In accordance with another aspect of the present invention, there is provided a combustion cylinder construction for an oil space heater further comprising a heat ray reflecting means provided at a low temperature area of the heat-permeable cylinder interposed between two high temperature areas of the heat-permeable cylinder.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a combustion cylinder construction for an oil space heater according to the present invention will be hereinafter described with reference to the accompanying drawings.

Figure 1:
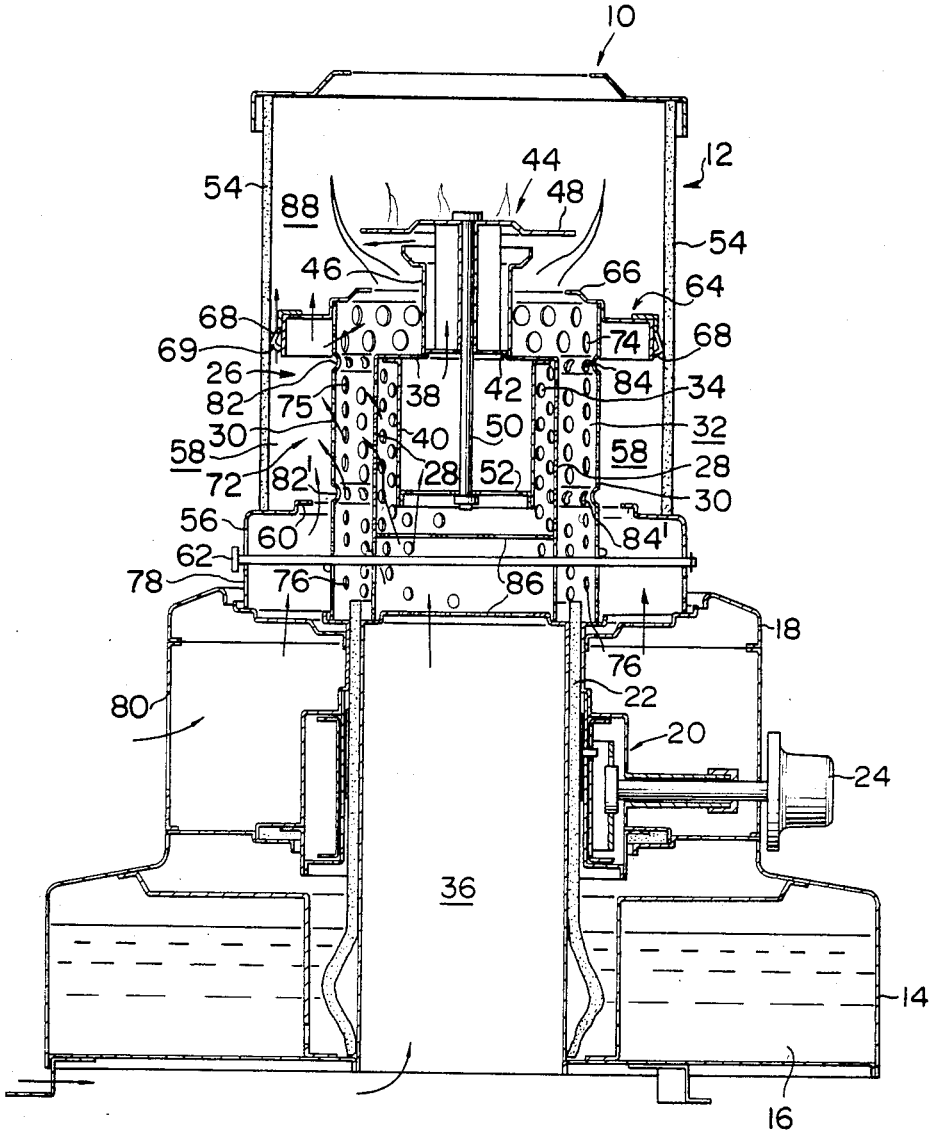
FIG. 1 is a vertical sectional view showing an oil space heater having one embodiment of a combustion cylinder construction for an oil space heater according to the present invention incorporated therein.

FIG. 1 illustrates an oil space heater of the type for emitting heat rays which has one embodiment of a combustion cylinder construction according to the present invention incorporated therein. In FIG. 1, an oil space heater and a combustion cylinder construction are designated by reference numerals 10 and 12, respectively.

The oil space heater 10 shown in FIG. 1 is constructed in such a manner as widely known in the art, except the combustion cylinder construction 12. The oil space heater 10 includes an oil tank 14 for storing a fuel oil 16 such as kerosene therein and a wick receiving case 18. In the wick receiving case 18, a wick moving mechanism 20 is provided which acts to move a wick 22 in the vertical direction by turning a knob 24.

The combustion cylinder construction 12 is disposed on the wick receiving case 18 and includes a double combustion cylinder 26 comprising an inner cylindrical member 28 and an outer cylindrical member 30 disposed concentric with the inner member 28 with a space 32 being defined therebetween, which are formed of a heat-resistant material such as ceramic. The inner cylindrical member 28 is provided with a plurality of small through-holes 34 through which the part of a combustion air is introduced from the lower portion of an internal cylindrical space 36 defined in the oil space heater to the space 32. The inner cylindrical member 28 also has an annular top plate 38 inwardly extending so as to surround the top portion of a central cylinder 40 concentrically disposed in the inner cylindrical member 28. The top plate 38 has a circular opening 42 defined at the central portion thereof.

On the central cylinder 40, a flame spreading means 44 is mounted through the top plate 38. The flame spreading means 44 includes a cylindrical member 46 mounted on the top plate 38 so as to communicate through the opening 42 with the central cylinder 40 and the space 36. Also, the flame spreading means 44 includes a flame spreading plate 48 disposed above the cylindrical member 46 so as to cover the member 46 and space therefrom with a gap being defined therebetween. The plate 48 is supported through a bolt 50 by a perforated plate 52 provided at the lower portion of the central cylinder 40. A part of the combustion air for the flame spreading means 44 is supplied from the exterior of the oil space heater through the inner cylindrical space 36, the central cylinder 40 and the cylindrical member 46 to the flame spreading plate 48.

The combustion cylinder construction 12 also includes a single heat-permeable cylinder 54 supported through a non-permeable cylinder 56 on the wick receiving case 18. The heat-permeable cylinder 54 is preferably transparent. The single heat-permeable cylinder 54 is disposed to surround both the red-heated portion of the outer cylindrical member 30 of the double combustion cylinder 26 and the flame spreading means 44, with a space 58 being defined between the heat-permeable cylinder 54 and the member 30. The connecting portion between the cylinders 54 and 56 may be provided with a perforated plate 60 extending toward the outer cylindrical member 30 which acts to control combustion air to be supplied to the space 58. Reference numeral 62 indicates a pin member which serves to concentrically hold the inner and outer cylindrical members 28 and 30 and the non-permeable cylinder 56 with respect to one another at predetermined intervals.

One feature of a combustion cylinder construction of the present invention is that a uniform flow forming mechanism is provided for rendering the flow of combustion air supplied through the space 58 to the outside of the flame spreading means 44 uniform with respect to the entire periphery of the flame spreading means 44 to form a uniform and stable long white-yellow flame at the outside of the flame spreading plate. In the embodiment illustrated in FIG. 1, the uniform flow forming mechanism is generally indicated by reference numeral 64 and comprises a top plate 66 provided at the upper end of the outer cylindrical member 30 so as to extend toward the heat-permeable cylinder 54 and a spacer means 68 provided between the top plate 66 and the heat-permeable cylinder 54 so as to space the top plate from the cylinder 54 at a fixed distance. The mechanism 64 in the embodiment illustrated is constructed in a manner such that the supply of combustion air from the space 58 to the outside of the flame spreading means 44 is accomplished through the spacer means 68. More particularly, the spacer means 68 comprises an annular member of a uniform width formed of an elastic material such as a metal sheet and provided with a plurality of through-holes 69 in the circumferential direction which form a passage sufficient to allow combustion air to be uniformly supplied therethrough from the space 58 to the outside of the flame spreading plate 48. The top plate 66 may be provided with a plurality of small through-holes which are circumferentially disposed at substantially regular intervals, to thereby increase the supply of a combustion air. In the embodiment illustrated in FIG. 1, the top plate 66 is bent at the outer end portion thereof and the spacer means 68 is attached at one end thereof to the top plate and is elastically contacted at the other end thereof with the heat-permeable cylinder. The spacer means may comprise a plurality of spacing members formed of an elastic metal plate and disposed on the periphery of the top plate 66 so as to be spaced from one another at regular intervals and elastically contacted with the inner surface of the heat-permeable cylinder, to thereby form a passage of a uniform width between the top plate and the heat-permeable cylinder.

Figure 2:
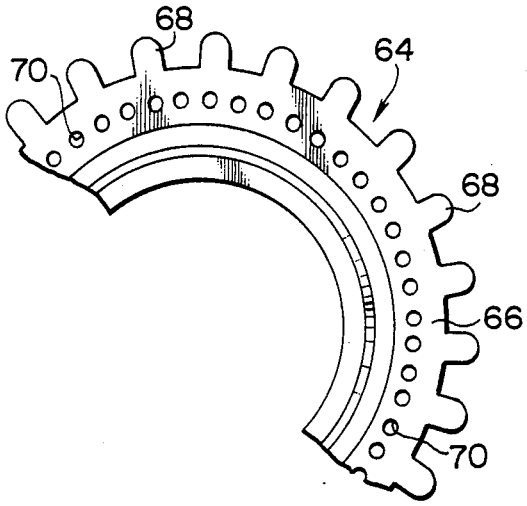
FIG. 2 is an enlarged partial plan view showing an example of a top plate provided on an outer cylindrical member of a double combustion cylinder of the combustion cylinder construction shown in FIG. 1.

Alternatively, the uniform flow forming mechanism 64 may be formed in such a manner as shown in FIG. 2. More particularly, the uniform flow forming mechanism 64 comprises an annular top plate 66 formed of an elastic metal plate having a plurality of protuberances 68' integrally formed on the periphery of the top plate so as to be spaced from one another at regular intervals and elastically contacted with the inner surface of the heat-permeable cylinder 54. The top plate 66 may be provided with small through-holes 70 in the circumferential direction thereof. The mechanism 64 of such construction significantly improves the workability and decreases the manufacturing cost. Also, the uniform flow forming mechanism 64 may comprise a top plate bent at the outer end portion thereof in the vertical direction and elastic spacing members of metal fixedly disposed at regular intervals between the bent portion of the top plate and the heat-permeable cylinder.

The outer cylindrical member 30 has a plurality of holes provided therethrough. Through-holes 72 of the member 30 provided above the perforated plate 60 are preferably larger in size than the through-holes 34 of the inner cylindrical member 28. Upper through-holes 74 provided near the top plate 66 are preferably formed to have a larger size than middle through-holes 75. Lower through-holes 76 below the perforated plate 60 may be formed to have the substantially same size as the through-holes 34 of the inner cylindrical member 28. The portion of the outer cylindrical member 30 at which the lower through-holes 76 are provided is preferably surrounded by the non-permeable cylinder 56 so that it may be put out of sight. The lower through-holes 76 act to guide a part of the combustion air for the space 32 from openings 78 and 80 respectively provided at the non-permeable cylinder 56 and the wick receiving case 18 therethrough to the space 32. In the space 32, fuel oil vaporized from the wick 22 is mixed with a combustion air introduced through the through-holes 34 of the member 28 and the lower through-holes 76 of the member 30 and is heated to form a combustible gas in the lower portion of the space 32. A part of the combustible gas is burned in the space 32.

The outer cylindrical member 30 preferably has a recess 82 semi-circular in section provided in the circumferential direction thereof at a boundary section between the middle through-holes 75 and the upper through-holes 74. The recess 82 is provided therethrough with a plurality of holes 84. Also, in the embodiment illustrated, another recess 82' having through-holes 84' is provided at a boundary section between the middle through-holes 75 and the lower through-holes 76. The through-holes 74, 75, 76, 84 and 84' may be formed in various shapes such as a slit shape, an elliptic shape and the like as desired, although these are formed in a circular shape in the illustrated embodiment.

Reference numeral 86 indicates perforated plates for controlling the flow of a combustion air to be supplied from the internal cylindrical space 36 to the space 32 and the flame spreading means 44.

The manner of operation of the combustion cylinder construction shown in FIG. 1 will now be explained.

Fuel oil vaporized from the wick 22 is mixed, in the lower portion of the space 32 between the inner and outer cylindrical members 28 and 30, with combustion air introduced from the exterior of the heater 10 through the through-holes 34 of the inner cylindrical member 28 and the lower through-holes 76 of the outer cylindrical member 30, to form a combustible gas. A part of the combustible gas, when igniting the heater, burns in the middle and upper portions of the space 32 using combustion air mainly supplied from the through-holes 34 of the inner cylindrical member 28 to heat the cylindrical members 28 and 30 and produce gaseous products of combustion. The gaseous products of combustion have a large volume as compared to the combustible gas, resulting in a draft generated in the space 32 being weakened. And, a draft in the space 58 between the heat-permeable cylinder 54 and the outer cylindrical member 30 becomes larger than the draft in the space 32. This allows a large volume of the combustible gas in the space 32 to be easily sucked through the through-holes 72 of the outer cylindrical member 30 into the space 58 in close proximity to the outer surface of the member 30. Thus, the combustible gas starts to burn on the outer surface of the outer cylindrical member 30 heated by combustion of a part of the combustible gas in the space 32, using a part of a combustion air supplied to the space 58. In such case, when the lower recess 82' having the through-holes 84' is provided at the outer cylindrical member 30, the combustible gas in the space 32 can be more easily sucked through the through-holes 84' into the space 58. In addition, when the middle through-holes 75 are formed to have a size larger than the through-holes 34 of the inner cylindrical member 28, the sucking of the combustible gas through the through-holes 75 into the space 58 is more easily accomplished because the flow resistance of the combustible gas passing through the holes 75 is less.

The gaseous products of combustion of a high temperature, produced by combustion of the combustible gas on the outer surface of the member 30, go up along the outer surface and enter through the upper through-holes 74 into the space 32, together with a part of the combustion air in the space 58. In this instance, when the upper recess 82 having the through-holes 84 is provided on the outer cylindrical member 30, the gaseous products of combustion are easily guided through the through-holes 84 to the upper portion of the space 32 because the flow direction of the gaseous products of combustion is easily changed toward the recess 84 at the lower portion thereof. In addition, when the upper through-holes 74 are larger in size than the middle through-holes 75, a part of the combustion air in the space 58 is more effectively guided through the through-holes 74 to the upper portion of the space 32. Then, the gaseous products of combustion are guided to the flame spreading means 44, together with any incompletely combusted gas and the rest of the combustible gas produced from the double combustion cylinder 26. The flame spreading means 44 is also supplied thereto a combustion air through the uniform flow forming mechanism 64 as well as the internal cylindrical space 36 from the exterior of the heater 10, to thereby accomplish complete combustion of the incompletely combusted gas and combustible gas generated from the double combustion cylinder 26.

In the embodiment illustrated, the uniform flow forming mechanism 64 is provided between the outer cylindrical member 30 and the single heat-permeable cylinder 54 which comprises the top plate 66 of the outer cylindrical member 30 and the elastic spacer means 68 serving to provide the combustion air passage between the top plate 66 and the heat-permeable cylinder 54 and space the top plate and the member 30 from the cylinder at a fixed distance. This allows the top plate 66 and the outer cylindrical member 30 to be concentrically disposed with respect to the heat-permeable cylinder 54. Thus, it is possible to accomplish the supply of a combustion air of the substantially same flow rate through the entire area between the heat-permeable cylinder 54 and the top plate to the outside of the flame spreading means 44, to thereby form an uniform and stable long white-yellow flame at the flame spreading means. Further, it is possible to prevent the variation in pressure between the outer cylindrical member 30 and the heat-permeable cylinder 54, to thereby more effectively red-heat the double combustion cylinder 24.

In the embodiment of FIG. 1, the inner end of the top plate 66 of the outer cylindrical member 30 may be extended substantially above the top end of the inner cylindrical member 28 to more effectively prevent a draft generated in a space 88 between the heat-permeable cylinder 54 and the flame spreading means 44 from effecting the space 32 in the double combustion cylinder 26, so that an area of a strong negative pressure may be formed in a space above the top plate 38 of the inner cylindrical member 28.

Figure 3:
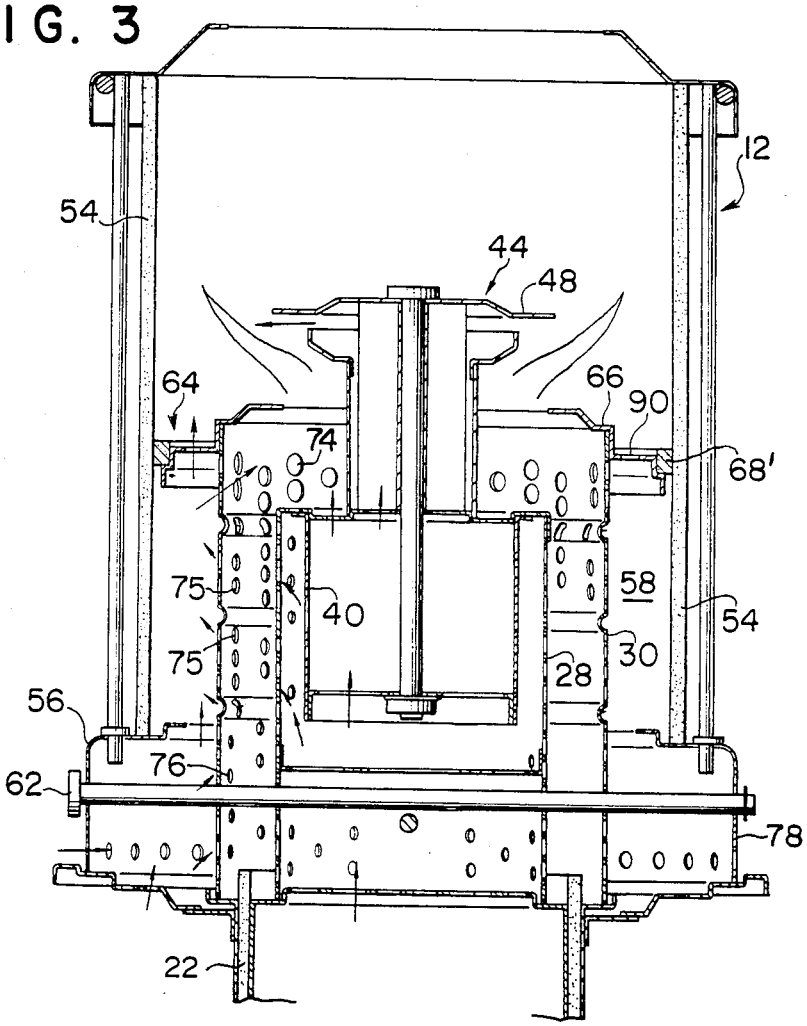
FIG. 3 is a vertical sectional view showing another embodiment of a combustion cylinder construction for an oil space heater according to the present invention.

FIG. 3 illustrates another embodiment of a combustion cylinder construction for an oil space heater according to the present invention. The embodiment is constructed in the substantially same manner as the embodiment of FIG. 1, except for the uniform flow forming mechanism 64. The uniform flow forming mechanism 64 of the present embodiment is adapted to provide a top plate with a passage for uniformly supplying a combustion air to a flame spreading means. The mechanism 64 includes a top plate 66 provided at the upper end of an outer cylindrical member 30 so as to extend toward a heat-permeable cylinder 54. The top plate 66 is bent at the outer end thereof in the vertical direction. The mechanism 64 also includes a spacer means 68 annular in shape securely interposed between the bent portion of the top plate 66 and the heat-permeable cylinder 54 so as to space the top plate 66 from the cylinder 54 at a fixed distance, spacer means 68 being formed of a heat-insulating sealing material. The top plate 66 is formed with a plurality of through-holes 90 which are arranged in the circumferential direction at substantially regular intervals so as to form a passage for uniformly supplying a combustion air therethrough from a space 58 to the outside of a flame spreading means 44. The passage may be formed by an annular opening provided at the top plate instead of the through-holes 90. Thus, it will be noted that the embodiment illustrated is capable of accomplishing the uniform supply of a combustion air through the entire area between the heat-permeable cylinder 54 and the top plate 66 to form a uniform and stable long white-yellow flame at the flame spreading means 44 and effectively preventing the variation in pressure between the outer cylindrical member 30 and the heat-permeable cylinder which adversely affects the red-heated outer cylindrical member 30.

Figure 4:
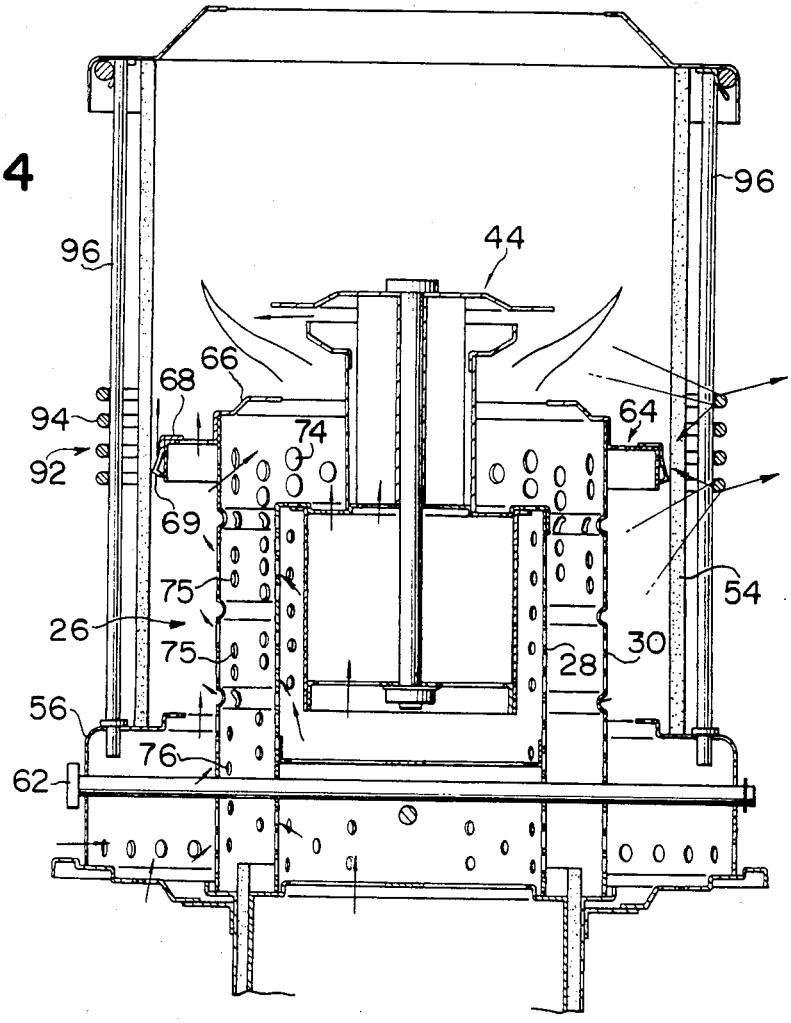
FIG. 4 is a vertical sectional view showing a further embodiment of a combustion cylinder construction for an oil space heater according to the present invention.
Figure 5:
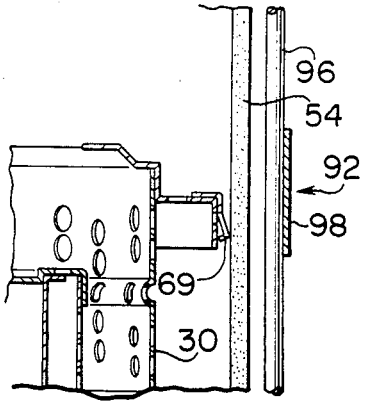
FIG. 5 is a enlarged partially sectional view showing a modification of a heat ray reflecting means used in the combustion cylinder construction shown in FIG. 4.

Still a further embodiment of a combustion cylinder construction of the present invention is illustrated in FIG. 4. The embodiment of FIG. 4 is adapted to provide a heat-permeable cylinder with gentle or smooth temperature profiles as well as form a uniform and stable long white-yellow flame at the outside of a flame spreading means. More particularly, the embodiment is constructed in a manner such that a heat ray reflecting means 92 is provided at a low temperature area of a heat-permeable cylinder 54 interposed between two high temperature areas thereof or through which only a small amount of heat rays are radiated from a red-heated outer cylindrical member 30 and a white-yellow flame formed at a flame spreading means 44; more particularly, the portion of the cylinder 54 positioned at the upper portion of a double combustion cylinder 26, between the double combustion cylinder 26 and the flame spreading means 44 and/or at the lower portion of the flame spreading means 44. The heat ray reflecting means 92 may comprise a plurality of metal wires 94 wound with respect to the periphery of the heat-permeable cylinder 54, as shown in FIG. 4. The metal wires may be wound directly on the cylinder 54. However, the metal wires 94 are preferably wound on vertical studs 96 disposed around the heat-permeable cylinder 54 so as to be spaced therefrom at fixed intervals, to thereby increase the reflecting efficiency. Alternatively, the reflecting means 92 may comprises a flat metal strip 98 as shown in FIG. 5. The remaining parts of the embodiment shown in FIG. 4 are constructed in the substantially same manner as in FIG. 1.

In the present embodiment constructed in the manner as mentioned above, a part of heat rays emitted from the red-heated outer cylindrical member 30 and a white-yellow flame formed at the flame spreading means 44 is directed toward the heat ray reflecting means 92 and is reflected by the means 92 to shift in the direction of the heat-permeable cylinder 54. Thus, although heat rays radiated to the exterior of the combustion cylinder construction through the area of the heat-permeable cylinder between the two high temperature areas thereof are small in amount, such area is bathed in heat rays reflected by the heat ray reflecting means 92. This results in the area being heated to a high temperature, to thereby allow the heat-permeable cylinder 54 to have smooth temperature profiles. In this instance, the use of the flat metal strip 98 as the heat ray reflecting means as shown in FIG. 5 not only improves in heating efficiency as well as reflecting efficiency, because the metal strip itself is heated to a high temperature sufficient to emit heat rays therefrom. Also, the use of the metal wires 94 has, in addition to the advantage of heating the heat-permeable cylinder 54, another advantage of appealing warmth to the eyes because the wires reflect heat rays in the irregular directions to allow a part of the reflected light to be observed.

Thus, it will be noted that the embodiment shown in FIG. 5 is capable of rendering the temperature profiles of the heat-permeable cylinder significantly gentle or as uniform as possible, as compared with a conventional combustion cylinder construction, to eliminate the need of using an expensive crystallined glass, resulting in the heat-permeable cylinder providing with a good durability and being formed of a low-cost heat-resistant glass such as Pyrex.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A combustion cylinder construction for an oil space heater of the heat radiation type, comprising:

a double combustion cylinder comprising an inner cylindrical member and an outer cylindrical member each formed of a heat-resistant material and with through-holes, said double combustion cylinder being adapted to mix fuel oil vaporized from a wick with air introduced from a part of said through holes to form a combustible gas and burn a part of said combustible gas both in a first space defined between said inner cylindrical member and said outer cylindrical member and at the outer side of said outer cylindrical member to red-heat at least said outer cylindrical member;

a flame spreading means disposed above said double combustion cylinder to burn the rest of said combustible gas and any incompletely combusted gas contained in gases generated from said double combustion cylinder, to form and spread a white-yellow flame at the outside of said flame spreading means;

a heat-permeable cylinder formed of a heat-resistant material and disposed to surround said double combustion cylinder and said flame spreading means; and, a uniform flow forming means for providing a passage rendering a flow of combustion air supplied through a second space between said double combustion cylinder and said heat-permeable cylinder to the outside of said flame spreading means substantially uniform with respect to the entire periphery of said flame spreading means, said uniform flow forming means including top plate means positioned at an upper end portion of said outer cylindrical member so as to extend toward said heat-permeable cylinder and spacer means disposed between said top plate means and said heat-permeable cylinder so as to fix said top plate in spaced relation relative to said heat-permeable cylinder.

2. A combustion cylinder construction for an oil space heater of the heat radiation type, comprising:

a double combustion cylinder comprising an inner cylindrical member and an outer cylindrical member each formed of a heat-resistant material and with through-holes, said double combustion cylinder being adapted to mix fuel oil vaporized from a wick with air introduced from a part of said through holes to form a combustible gas and burn a part of said combustible gas both in a first space defined between said inner cylindrical member and said outer cylindrical member and at the outer side of said outer cylindrical member to red-heat at least said outer cylindrical member;

a flame spreading means disposed above said double combustion cylinder to burn the rest of said combustible gas and any incompletely combusted gas contained in gases generated from said double combustion cylinder, to form and spread a white-yellow flame at the outside of said flame spreading means;

a heat-permeable cylinder formed of a heat-resistant material and disposed to surround said double combustion cylinder and said flame spreading means; and, a uniform flow forming means, located at the top portion of said outer cylindrical member, for rendering the flow of a combustion air supplied through a second space between said double combustion cylinder and said heat-permeable cylinder to the outside of said flame spreading means substantially uniform with respect to the entire periphery of said flame spreading means, said uniform flow forming means comprising a top plate provided at an upper end portion of said outer cylindrical member so as to extend toward said heat-permeable cylinder and a spacer means disposed between said top plate and said heat-permeable cylinder so as to space said top plate from said heat-permeable cylinder at a fixed distance, and said spacer means being provided with a passage for uniformly supplying said combustion air therethrough from said second space to the outside of said flame spreading means.

3. A combustion cylinder construction for an oil space heater as defined in claim 2, wherein said spacer means comprises an annular member of a uniform width formed of an elastic metal sheet and provided with a plurality of through-holes in the circumferential direction.

4. A combustion cylinder construction for an oil space heater as defined in claim 2, wherein said spacer means comprises a plurality of spacing members formed of an elastic metal plate and securely disposed on the periphery of said top plate so as to be spaced from one another at substantially regular intervals to define said passage and elastically contacted with said heat-permeable cylinder.

5. A combustion cylinder construction for an oil space heater as defined in claim 4, wherein said spacer means is formed integral with said top plate.

6. A combustion cylinder construction for an oil space heater as defined in claim 2, wherein said top plate is formed in an annular shape and provided with a plurality of small through-holes in the circumferential direction thereof and said spacer means comprises a plurality of protuberances integrally formed on the periphery of said top plate so as to be spaced from each other at substantially regular intervals and elastically contacted with the inner surface of said heat-permeable cylinder.

7. A combustion cylinder construction for an oil space heater of the heat radiation type, comprising:

a double combustion cylinder comprising an inner cylindrical member and an outer cylindrical member each formed of a heat-resistant material and with through-holes, said double combustion cylinder being adapted to mix fuel oil vaporized from a wick with air introduced from a part of said through holes to form a combustible gas and burn a part of said combustible gas both in a first space defined between said inner cylindrical member and said outer cylindrical member and at the outer side of said outer cylindrical member to red-heat at least said outer cylindrical member;

a flame spreading means disposed above said double combustion cylinder to burn the rest of said combustible gas and any incompletely combusted gas contained in gases generated from said double combustion cylinder, to form and spread a white-yellow flame at the outside of said flame spreading means;

a heat-permeable cylinder formed of a heat-resistant material and disposed to surround said double combustion cylinder and said flame spreading means; and, a uniform flow forming means, located at the top portion of said outer cylindrical member, for rendering the flow of a combustion air supplied through a second space between said double combustion cylinder and said heat-permeable cylinder to the outside of said flame spreading means substantially uniform with respect to the entire periphery of said flame spreading means, said uniform flow forming means comprising a top plate provided at an upper end portion of said outer cylindrical member so as to extend toward said heat-permeable cylinder and a spacer means disposed between said top plate and said heat-permeable cylinder so as to space said top plate from said heat-permeable cylinder at a fixed distance, said top plate being provided with through-holes which are arranged in the circumferential direction at substantially regular intervals to form a passage for uniformly supplying said combustion air from said second space to the outside of said flame spreading means, said spacer means being formed of a heat-insulating sealing material.

8. A combustion cylinder construction for an oil space heater as defined in claim 2 or 7, wherein said through-holes of said outer cylindrical member are divided into upper through-holes, middle through-holes and lower through-holes, said upper and middle through-holes being formed to have a size larger than said through-holes of said inner cylindrical member; and said outer cylindrical member is formed with recesses semi-circular in section in the circumferential direction thereof between said upper through-holes and said middle through-holes and between said middle through-holes and said lower through-holes, each of said recesses being formed with a plurality of through-holes which are arranged in the circumferential direction of said outer cylindrical member.

9. A combustion cylinder construction for an oil space heater as defined in claim 8, wherein said upper through-holes have a size larger than said middle through-holes.

10. A combustion cylinder construction for an oil space heater as defined in claim 9, wherein said heat-permeable cylinder is transparent.

11. A combustion cylinder construction for an oil space heater as defined in claim 10, wherein said heat-permeable cylinder is supported on a non-permeable cylinder which is disposed to surround the portion of said outer cylindrical member at which said lower through-holes are provided.

12. A combustion cylinder construction for an oil space heater as defined in claim 11, wherein the top end of said inner cylindrical member is positioned substantially below the inner end of said top plate of said outer cylindrical member.

13. A combustion cylinder construction for an oil space heater, comprising:

a double combustion cylinder comprising an inner cylindrical member and an outer cylindrical member each formed of a heat-resistant material and with through-holes, said double combustion cylinder being adapted to mix a fuel oil vaporized from a wick with an air introduced from a part of said through-holes to form a combustible gas and burn a part of said combustible gas in a first space defined between said inner cylindrical member and said outer cylindrical member;

a flame spreading means disposed above said double combustion cylinder to burn the rest of said combustible gas and an incomplete combustion gas contained in a combustion gas generated from said double combustion cylinder to form a white-yellow flame;

a heat-permeable cylinder formed of a heat-resistant material and disposed to surround said double combustion cylinder and said flame spreading means;

a uniform flow forming means for rendering the flow of a combustion air supplied from a second space between said outer cylindrical member and said heat-permeable cylinder to the outside of said flame spreading means substantially uniform with respect to the entire periphery of said flame spreading means; and a heat ray reflecting means provided at a low temperature area of said heat-permeable cylinder interposed between two high temperature areas of said heat-permeable cylinder.

14. A combustion cylinder construction for an oil space heater as defined in claim 13, wherein said heat ray reflecting means comprises a plurality of metal wires wound with respect to the periphery of said heat-permeable cylinder so as to be spaced from one another at intervals.

15. A combustion cylinder constructon for an oil space heater as defined in claim 13, werein said heat ray reflecting means comprises a flat metal strip wound with respect to the periphery of said heat-permeable cylinder.

16. A combustion cylinder construction for an oil space heater as defined in claim 14 or 15, wherein said heat ray reflecting means is wound on a supporting means disposed around said heat-permeable cylinder.

17. A combustion cylinder construction for an oil space heater as defined in claim 1, wherein there is a single heat-permeable cylinder.

18. A combustion cylinder construction for an oil space heater as defined in claim 13, wherein there is a single heat-permeable cylinder.

* * * * *